US005497221A

United States Patent [19]

Takemoto

[11] Patent Number: 5,497,221

[45] Date of Patent: Mar. 5, 1996

[54] METHOD OF ADJUSTING IMAGE DENSITY PARAMETERS BY REPETITIVELY ADJUSTING IMAGE DENSITY PARAMETER VALUES BASED UPON REFERENCE PATTERN DENSITY AT STANDBY TIME INTERVALS

[75] Inventor: Mitsutoshi Takemoto, Osaka, Japan

[73] Assignee: Mita Industrial Co., Ltd., Osaka, Japan

[21] Appl. No.: 304,483

[22] Filed: Sep. 12, 1994

[30] Foreign Application Priority Data

Sep. 20, 1993 [JP] Japan ..... 5-257797

[51] Int. Cl.[6] ..... G03G 21/00

[52] U.S. Cl. ..... 355/246; 355/208

[58] Field of Search ..... 355/203, 204, 355/208, 214, 246

[56] References Cited

U.S. PATENT DOCUMENTS 5,006,896 4/1991 Koichi et al. ..... 355/246

5,057,867 10/1991 Ishigaki et al. ..... 355/208

5,200,780 4/1993 Koichi ..... 355/208

5,245,390 9/1993 Ishigaki et al. ..... 355/246

*Primary Examiner*—William J. Royer

*Attorney, Agent, or Firm*—Beveridge, DeGrandi Weilacher & Young

[57] ABSTRACT

The present invention is directed to a density parameter adjusting method in which adjustment of parameters on an image density based upon detection of a density of a toner image related to a reference density pattern and results of the density detection is repetitively performed at intervals of a standby time so as to obtain appropriate values of the parameters on the image density. The standby time is found based upon a level of drive current for a reflection type photosensor which is set in detecting the density of the toner image related to the reference density pattern.

7 Claims, 5 Drawing Sheets

METHOD OF ADJUSTING IMAGE DENSITY PARAMETERS BY REPETITIVELY ADJUSTING IMAGE DENSITY PARAMETER VALUES BASED UPON REFERENCE PATTERN DENSITY AT STANDBY TIME INTERVALS

FIELD OF THE INVENTION

The present invention relates to a density parameter adjusting method in an image formation apparatus such as a copying machine and the like.

PRIOR ART

In a copying machine, an original image is exposed to light to form an electrostatic latent image on a photoconductor drum. Then, a developing device develops the electrostatic latent image to form a toner image on the photoconductor drum. After that, a transfer device transfers the toner image on recording paper.

In order to obtain an appropriate image density, a density of the toner image related to a specified density of the original image must be kept fixed. Thus, in the prior art, values on various parameters on density including a quantity of exposing light, a potential of electrostatic charge on the photoconductor and developing bias (referred to as "density parameter values" hereinafter) are adjusted.

For example, a reference density pattern is exposed to light to form an electrostatic latent image of the reference density pattern on the photoconductor drum, and the density of the toner image developed on the photoconductor drum is detected by a reflection type photosensor. Thus, based upon output from the reflection type photosensor, the density parameter values are adjusted.

In such a prior art method, however, there arises an error in detection of the density of the toner image related to the reference density pattern because of variations in features of a light emitting element and light receiving element of the reflection type photosensor, variations in positional relation between these elements, variations in mounting position of the reflection type photosensor, foulness on a light emitting surface of the light emitting element and on a light receiving surface of the light receiving element, variations with elapse in components such as deterioration, environmental variations including temperature and humidity. Hence, the prior art technique has the disadvantage that precise density adjustment cannot be performed.

To overcome the above mentioned disadvantage, the applicant of this invention has developed an image density control method as follows. Before adjusting density parameters, drive current for the reflection type photosensor is varied without toner on the photoconductor to measure an output from the reflection type photosensor. Then, a level of reference drive current for the reflection type photosensor at which the output from the reflection type photosensor is at a predetermined level is found (hereinafter, referred to as "procedure of determining the reference drive current level). The drive current for the reflection type photosensor in measuring the density of the toner image related to the reference density pattern is set to the reference drive current level.

In adjustment of the density parameters, values of the density parameters based upon measurement by the reflection type photosensor of the density of the toner image related to the reference density pattern and its resultant values are adjusted repetitively more than ten times up to several tens times to obtain appropriate density parameter values.

However, when the photoconductor drum is irradiated with light (generally, infrared light) from the reflection type photosensor, the so-called drum light fatigue is caused by which a potential of part of the photoconductor drum irradiated with light is reduced to make it difficult to move toner toward the photoconductor drum. When the measurement of the density is executed a second time or later not recovering from the drum light fatigue, the density measurement cannot be precisely performed. Thus, each time the measurement of the density and the adjustment of the density parameters are performed, after standby for a period of time determined by allowing for a time necessary for recovering from the drum light fatigue, the next detection of the density and adjustment of the density parameters are performed.

However, the time required for recovering from the drum light fatigue varies depending upon a quantity of light emitted from the reflection type photosensor. In other words, the time required for recovering from the drum light fatigue varies depending upon the drive current for the reflection type photosensor. The drive current for the reflection type photosensor is not always constant because it is, as previously mentioned, determined by the procedure of determining the reference drive current value before the detection and adjustment of the density parameters. Thus, in the current technique, the time required for recovering from the drum light fatigue under the condition that the quantity of light emitted from the reflection type photosensor is at its maximum level is set as a standby time.

In such a manner, however, when the quantity of light actually emitted from the reflection type photosensor is lower than the above-mentioned maximum level, the standby time becomes unnecessarily longer, and the time required for adjusting the density parameters accordingly becomes longer.

SUMMARY OF THE INVENTION

An object of the present invention is to provide a method of adjusting parameters on density according to which a time required for density parameter adjustment can be shortened.

In an aspect of the present invention, the method of adjusting parameters on density comprises the steps of (i) determining a level of reference drive current for a reflection type photosensor, (ii) finding a standby time allowing for a time required for recovering from light fatigue of the photoconductor which is caused by irradiating the photoconductor with light from the reflection type photosensor based upon the level of the reference drive current determined in the previous step (i), (iii) imaging a reference density pattern on the photoconductor, (iv) setting the drive current for the reflection type photosensor to the level of the reference drive current obtained in the previous step (i) to detect the density of an image of the reference density pattern on the photoconductor by the reflection type photosensor, (v) adjusting values of parameters on an image density based upon the density of the image of the reference density pattern obtained in the previous step (iv) and/or other factors, and (vi) repetitively performing the previous steps (iii) to (v) at intervals of the standby time obtained in the previous step (ii) to obtain appropriate values of the parameters on the image density.

Step (i) includes, for example, the steps of measuring an output from the reflection type photosensor without toner on the photoconductor by varying the drive current for the reflection type photosensor, and determining, as the level of the reference drive current, a level of the drive current for the reflection type photosensor at which the output from the reflection type photosensor is at a predetermined level.

As to step (ii), for example, the standby time is found based upon a relation between the drive current and the standby time of the reflection type photosensor obtained in advance and upon the level of the reference drive current determined in step (i).

The parameters on the image density include a quantity of exposing light, a quantity of electrostatic charge in the photoconductor and developing bias.

In another aspect of the present invention, the method of adjusting parameters on density comprises the steps of (i) measuring an output from a reflection type photosensor without toner on a photoconductor by varying the drive current for the reflection type photosensor, (ii) finding a level of reference drive current for the reflection type photosensor at which the output from the reflection type photosensor is at a predetermined level, (iii) finding a standby time allowing for a time required for recovering from light fatigue of the photoconductor which is caused by irradiating the photoconductor with light from the reflection type photosensor, (iv) imaging a reference density pattern on the photoconductor, (v) setting the drive current for the reflection type photosensor to the level of the reference drive current obtained in step (ii) to detect a density of an image of the reference density pattern on the photoconductor, (vi) adjusting values of parameters on an image density based upon the density of the image of the reference density pattern obtained in step (v) and/or other factors, and (vii) repetitively performing the previous steps (iv) to (vi) at intervals of the standby time obtained in step (iii) to obtain appropriate values of the parameters on the image density.

As to step (iii), for example, the standby time is found based upon a relation between the drive current and the standby time of the reflection type photosensor obtained in advance and upon the level of the reference drive current determined in step (i).

The parameters on the image density include a quantity of exposing light, a quantity of electrostatic charge in the photoconductor and developing bias.

The step of finding the level of the reference drive current for the reflection type photosensor may be necessarily performed before measuring the density of the image of the reference density pattern on the photoconductor or may be performed every fixed period or every specified times of image formation.

DETAILED DESCRIPTION OF THE PREFERRED EMBODIMENT

Preferred embodiments of the present invention will now be described with reference to the accompanying drawings.

Figure 1:
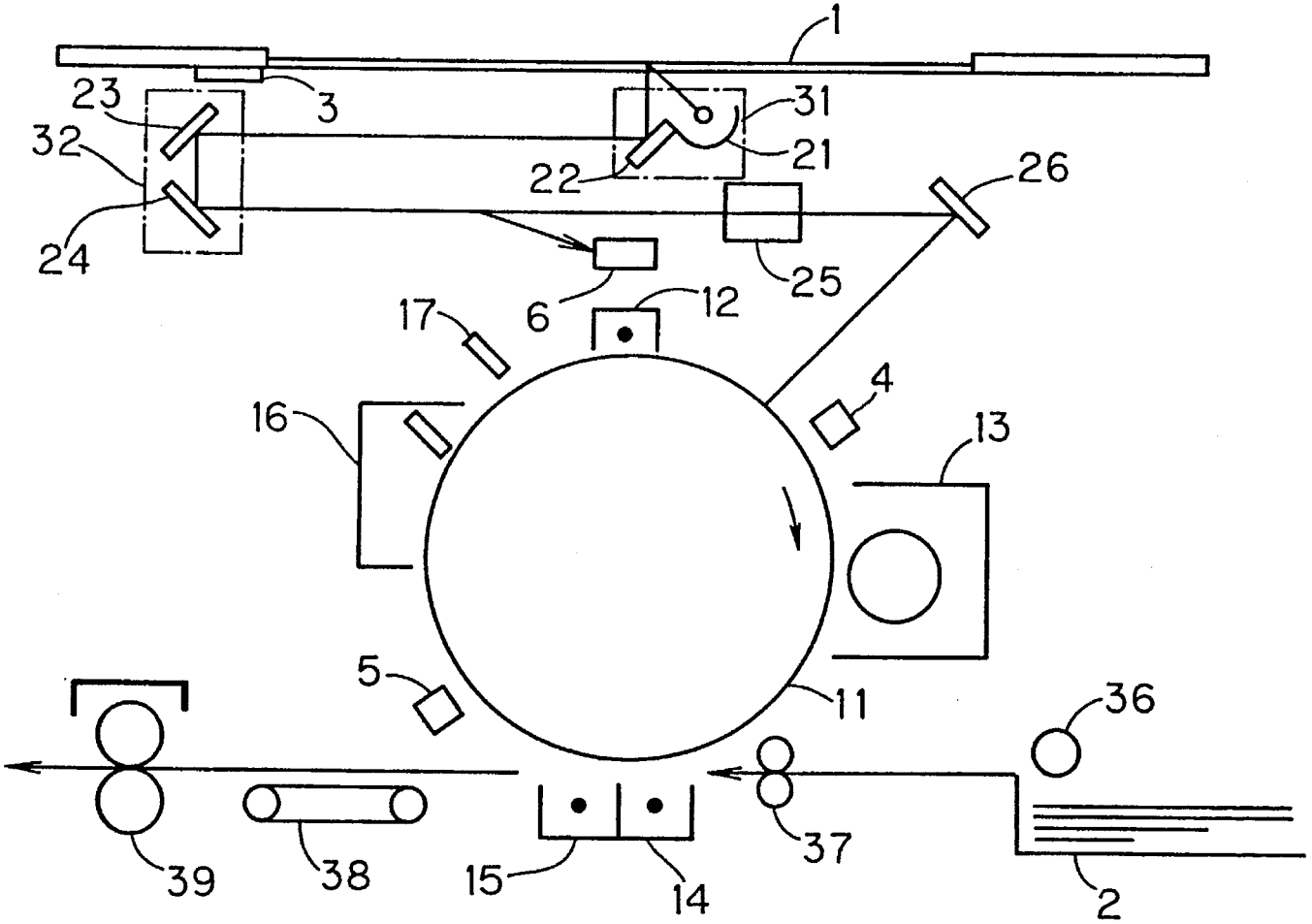
FIG. 1 is a schematic diagram showing a model arrangement of a copying machine.

FIG. 1 shows an arrangement of an electrophotographic copying machine.

In an upper portion of a main body of the copying machine, there is provided a contact glass plate 1 on which an original sheet to be copied is set. On one side of the main body of the copying machine, a sheet supply cassette 2 is attached. Within the main body of the copying machine, there are arranged an exposing mechanism, a print mechanism and a recording paper carrying mechanism. Close to one side of the contact glass plate 1, a sample original 3 where a reference density pattern is recorded is attached.

The print mechanism has a photoconductor drum 11. The photoconductor drum 11 is rotated in a direction indicated by the arrow by a main motor (not shown). Surrounding the photoconductor drum 11, there lie an electrostatic charger 12 for electrostatically charging a photosensitive layer of the photoconductor drum 11, a developing device 13 for imaging an electrostatic latent image formed on the photosensitive layer as a toner image, a transfer discharger 14 for transferring the toner image formed on the photosensitive layer to the recording paper, a separation discharger 15 for separating the recording paper from the photoconductor drum 11, a cleaning device 16 for removing toner remaining on the photoconductor drum 11 after transfer, and a discharger 17 for eliminating electric charge from the surface of the photoconductor drum 11 in order corresponding to the rotation of the photoconductor drum 11.

Also, along the photoconductor drum 11, there lie a surface potential sensor 4 for measuring electrostatic charge potential on the photoconductor drum 11, and a reflection type photosensor 5 for measuring a density of the toner image related to a reference density pattern on the sample original 3.

The exposing mechanism has a first optical system moving element 31 comprised of an exposing lamp 21 for exposing and scanning an image of an original (not shown) set on the contact glass plate 1 and a first mirror 22 for reflecting light emitted from the exposing lamp 21 and reflected from the original, a second optical system moving element 32 comprised of second and third mirrors 23 and 24 for guiding light reflected from the first mirror 22 toward a lens 25, and a fourth mirror 26 for guiding light coming out of the lens 25 toward the surface of the photoconductor drum 11. A light quantity sensor 6 for measuring a quantity of light reflected from the sample original 3 is provided.

The first and second optical system moving elements 31 and 32 are reciprocally moved in lateral directions in the drawing by a scan motor (not shown). The second optical system moving element 32 moves half as fast as the first optical system moving element 31 and half as far as the first optical system moving element 31.

The recording paper carrying mechanism has a sheet feed roller 36 for feeding a sheet of the recording paper in the sheet supply cassette 2, resist rollers 37 for carrying the recording paper sent by the sheet feed roller 36 to the photoconductor drum 11 at a specified timing, and a carrying belt 38 for carrying the recording paper, which has the toner image transferred from the photoconductor drum 11 and which is then separated from the photoconductor drum 11, to a fusing roller 39.

Figure 2:
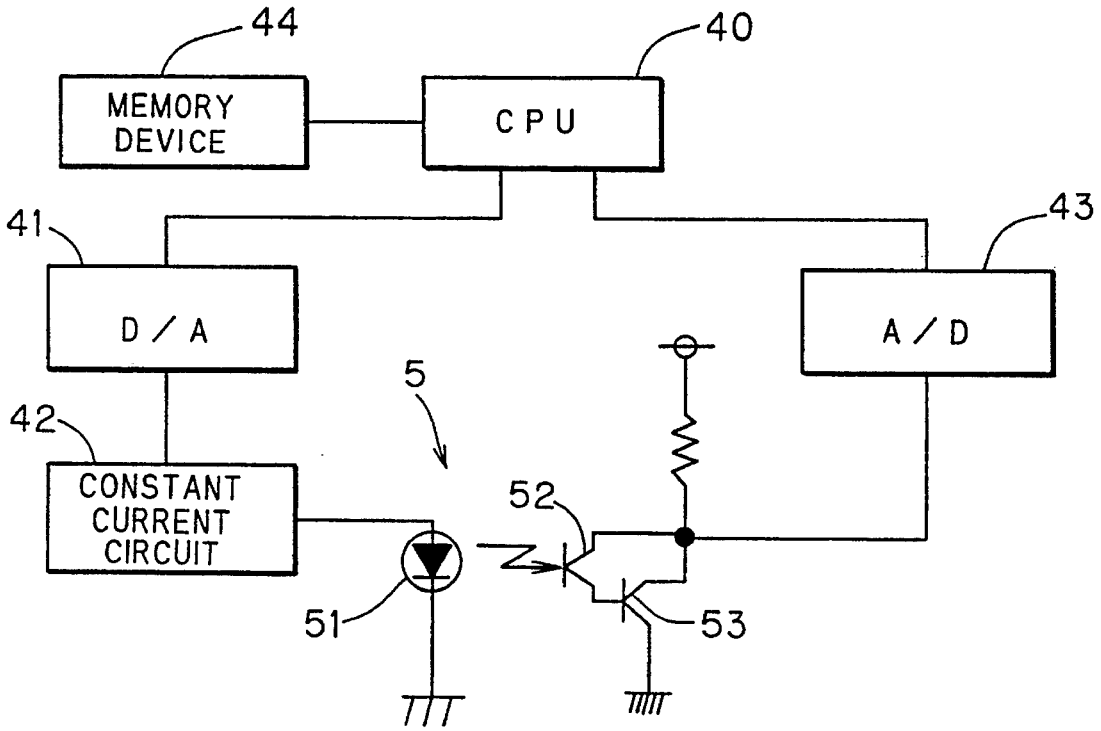
FIG. 2 is an electric block diagram showing a system architecture of a reflection type photosensor and its drive control circuit.

FIG. 2 depicts a system architecture of the reflection type photosensor 5 and its drive control circuit.

Figure 6:
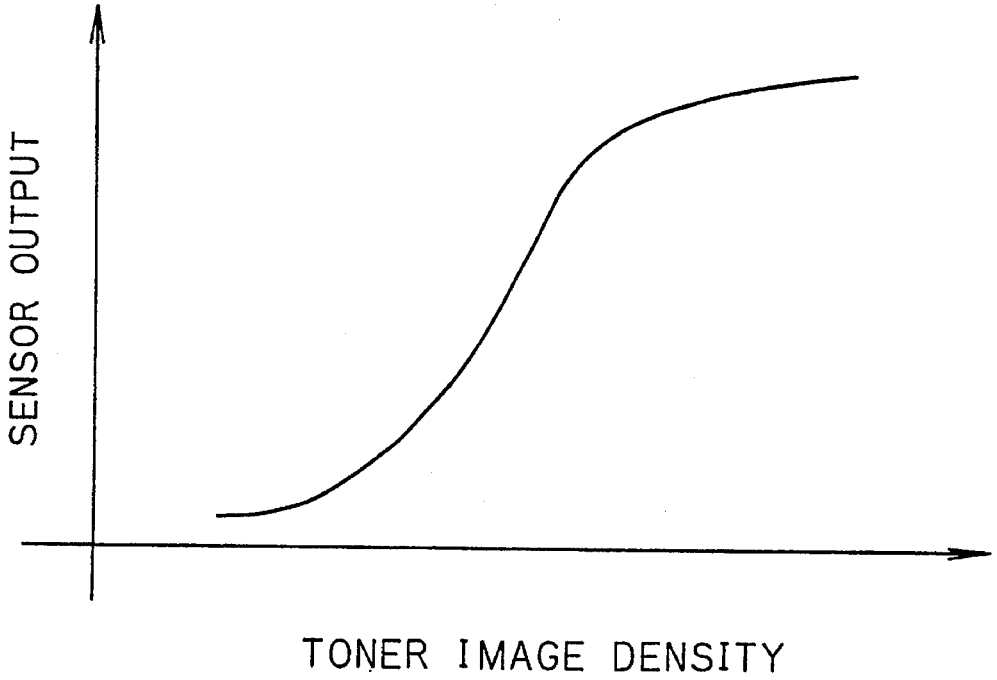
FIG. 6 is a graph illustrating a relation between a density of a toner image and the output of the reflection type photosensor.

The reflection type photosensor 5 has a light emitting unit including a light emitting diode 51 for irradiating the surface of the photoconductor drum 11 with light, and a light receiving unit including a phototransistor 52 for receiving reflected light and a transistor 53 for amplifying an output from the phototransistor 52. FIG. 6 illustrates a relation between a density of the toner image and an output from the reflection type photosensor 5 in the event of driving the reflection type photosensor 5 by drive current at a specified level.

Figure 4:
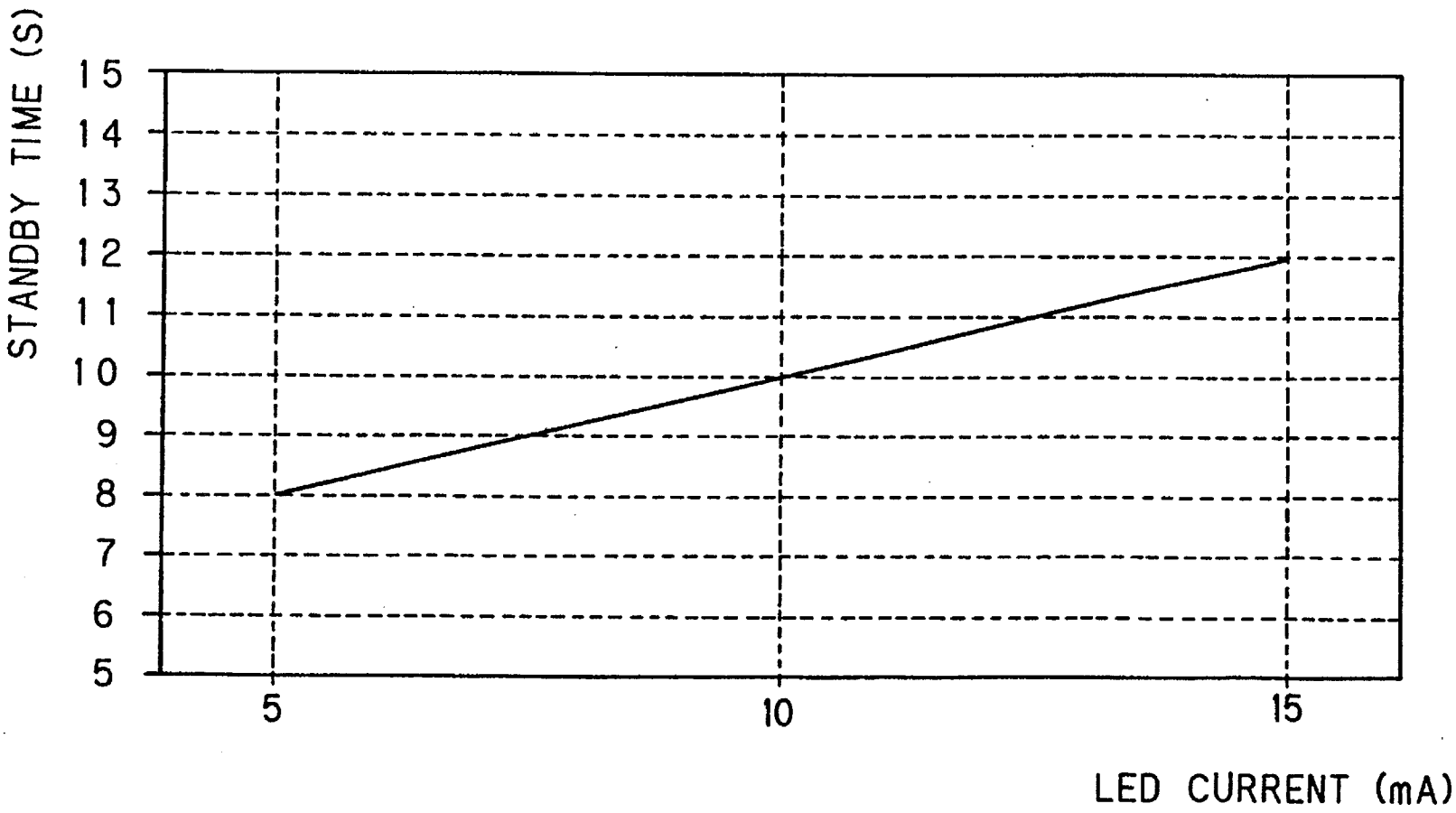
FIG. 4 is a graph illustrating a relation between drive current and standby time of the reflection type photosensor obtained by an experiment.

Drive current for the light emitting diode 51 is controlled by a CPU 40 controlling the copying machine. Specifically, when a digital signal designating the drive current is output from the CPU 40, the signal is converted into an analog signal by a D/A converter 41 and then transmitted to a constant current circuit 42. The constant current circuit 42 applies to the light emitting diode 51 the drive current at a current level in accordance with the analog signal received from the D/A converter 41. An output from the light receiving unit is, after converted into a digital signal by an A/D converter 43, transmitted to the CPU 40. The CPU 40 has a memory device 44 for storing its programs and required data. The memory device 44, as shown in FIG. 4, stores data on a standby time related to the drive current of the light emitting diode 51. The data is made based upon a time required for recovering from drum light fatigue of the photoconductor drum 11, which is empirically obtained, related to the drive current for the light emitting diode 51.

Figure 3:
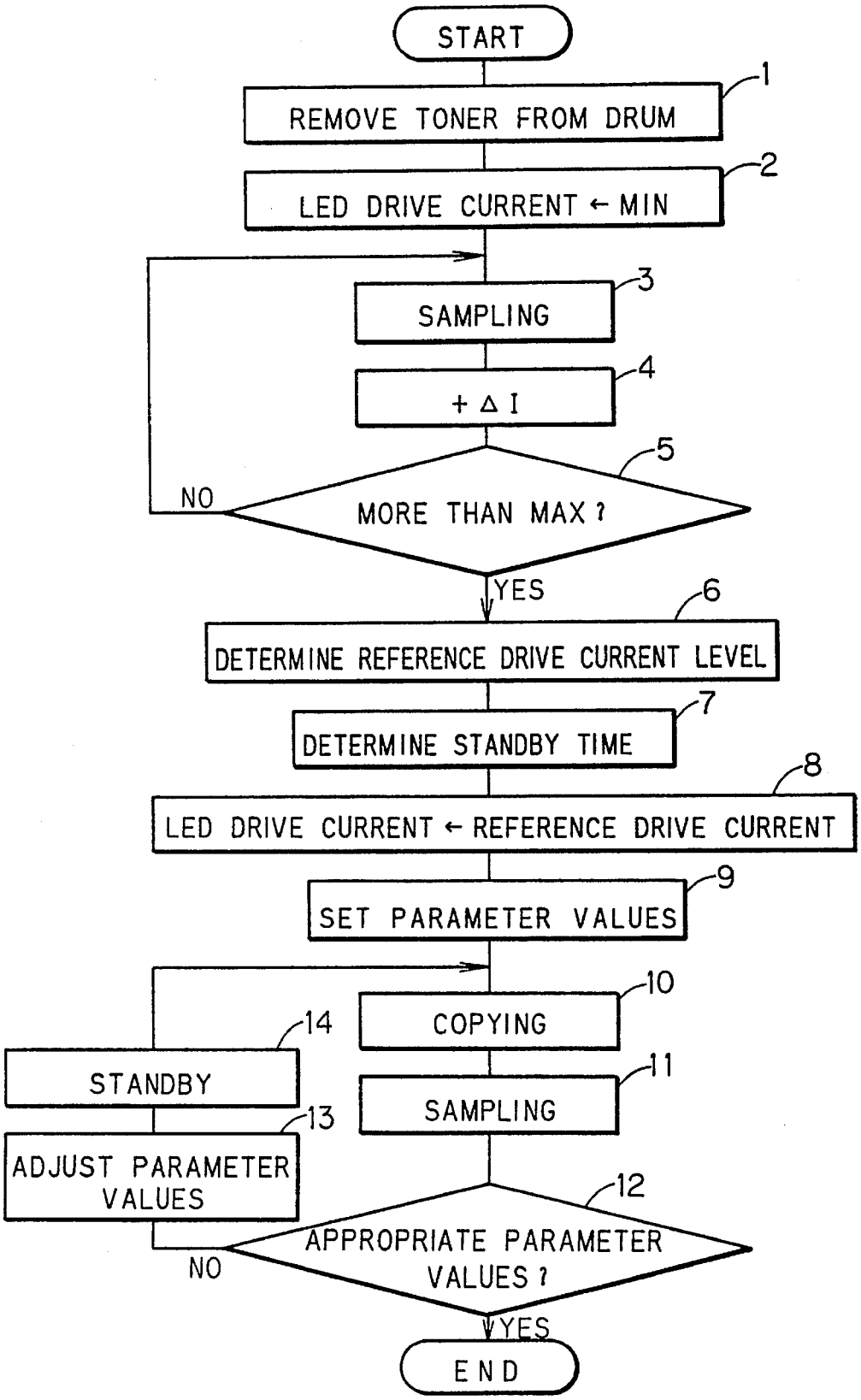
FIG. 3 is a flow chart illustrating a procedure of adjusting a density by a CPU.

FIG. 3 illustrates a procedure of density adjustment by the CPU 40.

A procedure of determining the level of the reference drive current is completed through Step 1 to 6, where the drive current for the reflection type photosensor 5 is varied to measure the output from the reflection type photosensor 5, and thus, the level of the reference drive current of the reflection type photosensor 5 at which the output from the reflection type photosensor 5 is at a predetermined level is obtained.

Specifically, toner is removed from the photoconductor drum 11 (Step 1). Removal of the toner is performed by using some of the devices surrounding the photoconductor drum 11, that is, by driving merely the cleaning device 16 and the discharger 17 to rotate the photoconductor drum 11 by a specified amount.

Then, a drive control signal is output so as to apply a predetermined minimum current MIN to the light emitting diode 51 (Step 2). In this way, the minimum current MIN is applied from the constant current circuit 42 to the light emitting diode 51 to drive the light emitting diode 51.

Furthermore, an output (a sensor output) of the light receiving unit of the reflection type photosensor 5 is taken in, and it is stored in the memory device 44 in relation with the drive current for the light emitting diode 51 at that moment (Step 3). After that, the drive control signal is output so as to increase the drive current for the light emitting diodes 51 by a predetermined amount $\Delta I$ (Step 4). In this way, output current from the constant current circuit 42 is increased by $\Delta I$.

Then, till the output current from the constant current circuit 42 becomes more than a predetermined maximum level, take-in of the sensor output (Step 3) and increase in the drive current (Step 4) are repetitively performed. When the output current from the constant current circuit 42 is more than the predetermined maximum level (Step 5), the level of the reference drive current at which the sensor output is at a predetermined level A is obtained based upon data on the sensor output related to the drive current stored in the memory device 44 (Step 6).

In this way, when the procedure of determining the level of the reference drive current is completed through Steps 1 to 6, a time corresponding to the level of the reference drive current obtained at Step 6 is determined as a standby time based upon data on the standby time related to the drive current of the light emitting diode 51 in FIG. 4 which is stored in the memory device 44 (Step 7). The output current from the constant current circuit 42 is controlled so as to be at the level of the reference drive current previously obtained (Step 8). Moreover, parameters on density including a quantity of exposing light, electrostatic charge voltage and developing bias are set to values determined in the previous procedure of adjustment (Step 9).

Then, a procedure of adjusting parameters on density is executed through Steps 10 to 13; that is, a process of copying is executed with the reference density pattern being exposed to light (Step 10). After that, sensing by the surface potential sensor 4, the reflection type photosensor 5 and the light quantity sensor 6 is performed, and resultant detection outputs are taken in (Step 11).

Specifically, a surface potential of the photoconductor drum 11 which is detected by the surface potential sensor 4, a density of the toner image related to the reference density pattern which is detected by the reflection type photosensor 5, and a quantity of light reflected from the sample original 3 which is detected by the light quantity sensor 6 are taken in, respectively.

It is determined if the values of the parameters on the density currently set are appropriate based upon the surface potential of the photoconductor drum 11, the density of the toner image related to the reference density pattern and the quantity of light reflected from the sample original 3 which are respectively taken in from the surface potential sensor 4, the reflection type photosensor 5 and the light quantity sensor 6 (Step 12).

If it is determined that the values of the parameters on the density currently set are inappropriate, the values of the parameters on density are adjusted based upon detection outputs from the surface potential sensor 4, the reflection type photosensor 5 and the light quantity sensor 6 (Step 13).

Then, after the standby time obtained at Step 7 elapses (Step 14), the procedure returns to Step 10. Thus, the procedure through Steps 10 to 14 are repetitively performed. Furthermore, at Step 12, this process is completed when it is determined that the values of the parameters on the density currently set are appropriate.

Figure 5:
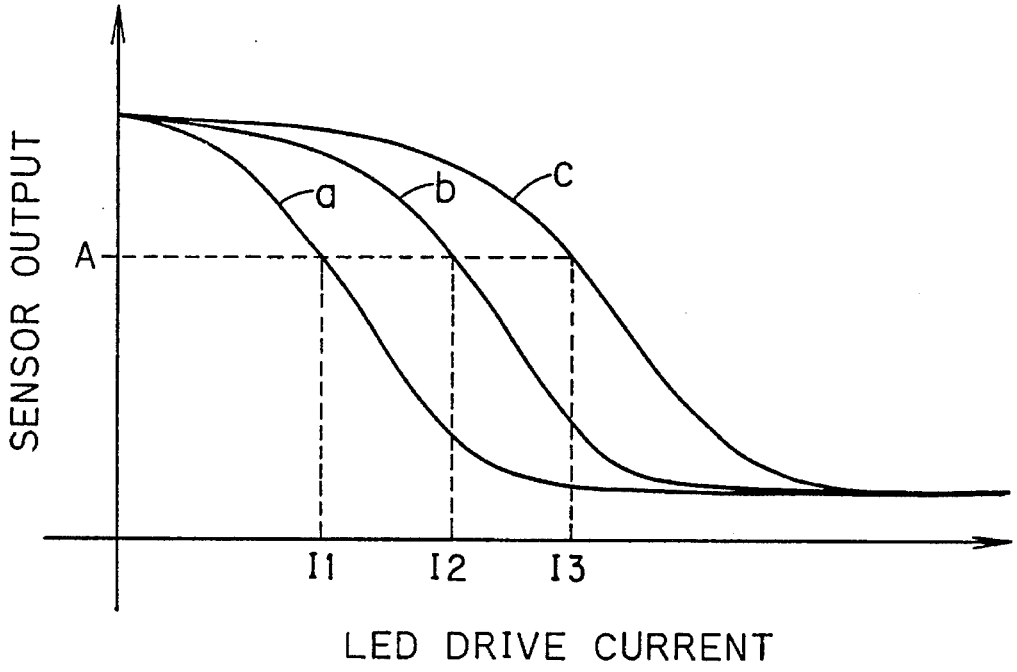
FIG. 5 is a graph illustrating a relation between the drive current and output of the reflection type photosensor obtained by a process of determining reference drive current.

FIG. 5 depicts the data on the sensor output related to the drive current attained through Steps 1 to 6 as mentioned above. As illustrated by curves a, b and c in FIG. 5, variations in feature of the reflection type photosensor, foulness on the light emitting surface and light receiving surface, deterioration of the reflection type photosensor, and variations in temperature, humidity and so on cause an output characteristic of the reflection type photosensor related to the drive current thereof to vary. In the above embodiment, however, the level of the reference drive current at which the sensor output is at the specified level A is found, and the density of the toner image related to the reference density pattern is measured while the reflection type photosensor is being driven by the reference drive current. Hence, since a measurement error caused by variations in output from the reflection type photosensor which are caused by various factors is corrected, precise density adjustment can be performed.

Also, in this embodiment, when the procedure of determining the level of the reference drive current is completed, a time corresponding to the level of the reference drive current obtained at Step 6 is determined as a standby time based upon the data on the standby time of the light emitting diode 51 in FIG. 4 related to the drive current thereof which are stored in the memory device 44 (see Step 7). Then, in the procedure of adjusting the parameters on density, adjustment of the parameters on density based upon sensing by the detectors and sensing results (Steps 10 to 13) are repetitively performed at intervals of the standby time determined at Step 7. Thus, the standby time required for recovering from drum light fatigue is a standby time corresponding to the actual drive current for the light emitting diode 51, and therefore, a time for the procedure of the adjustment of parameters on density can be shortened.

In addition to that, as to data on the standby time of the light emitting diode 51 related to the drive current thereof to find a standby time, empirically obtained data on the standby time related to the drive current of the light emitting diode 51 which is stored in a table in the memory device may be substituted, or alternatively a formula expressing an empirically obtained standby time of the light emitting diode 51 related to the drive current may be substituted.

What is claimed is:

1. A density parameter adjusting method comprising the steps of:

(i) determining a level of reference drive current for a reflection type photosensor;

(ii) finding a standby time for allowing a photoconductor to recover from light fatigue caused by irradiating the photoconductor with light from the reflection type photosensor based upon the level of the reference drive current determined in step (i);

(iii) imaging a reference density pattern on the photoconductor;

(iv) setting drive current for the reflection type photosensor to the level of the reference drive current obtained in step (i) to detect a density of an image of the reference density pattern on the photoconductor by the reflection type photosensor;

(v) adjusting values of image density parameters based upon at least the density of the image of the reference density pattern obtained in step (iv) and (vi) repetitively performing step (iii) to step (v) at intervals of the standby time obtained in step (ii) to obtain appropriate values of the image density parameters.

2. A method according to claim 1, wherein step (i) further includes the steps of measuring an output from the reflection type photosensor without toner on the photoconductor by varying the drive current for the reflection type photosensor, and determining, as the level of the reference drive current, a level of the drive current for the reflection type photosensor where the output from the reflection type photosensor is at a predetermined level.

3. A method according to claim 1, wherein, in step (ii), the standby time is found based upon a relation between the drive current for the reflection type photosensor and the standby time and upon the level of the reference drive current determined in step (i).

4. A method according to claim 1, wherein the image density parameters include at least one of a quantity of exposing light, a quantity of electrostatic charge on the photoconductor, and developing bias.

5. A density parameter adjusting method comprising the steps of:

(i) measuring an output from a reflection type photosensor without toner on a photoconductor by varying drive current for the reflection type photosensor, (ii) finding a level of reference drive current for the reflection type photosensor in which the output from the reflection type photosensor is at a predetermined level, (iii) finding a standby time required by the photoconductor to recover from light fatigue which is caused by irradiating the photoconductor with light from the reflection type photosensor, (iv) imaging a reference density pattern on the photoconductor;

(v) setting the drive current for the reflection type photosensor to the level of the reference drive current obtained in step (ii) to detect a density of an image of the reference density pattern on the photoconductor, (vi) adjusting values of image density parameters based upon at least the density of the image of the reference density pattern obtained in step (v) and (vii) repetitively performing step (iv) to step (vi) at intervals of the standby time obtained in step (iii) to obtain appropriate values of the image density parameters.

6. A method according to claim 5, wherein, in step (iii), the standby time is found based upon a relation between the drive current for the reflection type photosensor and the standby time and upon the level of the reference drive current determined in step (i).

7. A method according to claim 5, wherein the image density parameters include at least one of a quantity of exposing light, a quantity of electrostatic charge on the photoconductor, and developing bias.

* * * * *